US011650539B2

(12) United States Patent
Ishida et al.

(10) Patent No.: US 11,650,539 B2
(45) Date of Patent: May 16, 2023

(54) IMAGE FORMING APPARATUS INCLUDING A CABINET WITH A POSITIONING PART CONFIGURED TO FORM A SPACE BETWEEN A SIDE PLATE HAVING AN EXHAUST PORT AND THE CABINET

(71) Applicants: Masahiro Ishida, Kanagawa (JP); Ryuta Kaneda, Kanagawa (JP); Kentaro Uji, Kanagawa (JP)

(72) Inventors: Masahiro Ishida, Kanagawa (JP); Ryuta Kaneda, Kanagawa (JP); Kentaro Uji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 622 days.

(21) Appl. No.: 16/683,923

(22) Filed: Nov. 14, 2019

(65) Prior Publication Data

US 2020/0171866 A1 Jun. 4, 2020

(30) Foreign Application Priority Data

Nov. 30, 2018 (JP) ..... JP2018-224682

(51) Int. Cl.
*G03G 21/00* (2006.01)
*B41J 29/00* (2006.01)
(Continued)

(52) U.S. Cl.
CPC ..... *G03G 21/206* (2013.01); *A47B 81/00* (2013.01); *B41J 29/377* (2013.01);
(Continued)

(58) Field of Classification Search
CPC ..... G03G 21/206; G03G 2221/1645; G03G 21/1619; G03G 2221/1678; B41J 29/377;
(Continued)

(56) References Cited

U.S. PATENT DOCUMENTS 4,755,010 A * 7/1988 Wilson ..... B41J 29/06 312/208.2
5,887,226 A * 3/1999 Taki ..... G03G 21/206 399/92
(Continued)

FOREIGN PATENT DOCUMENTS

CN 205080669 U * 3/2016
CN 206292922 U * 6/2017
(Continued)

OTHER PUBLICATIONS

Communication with the Dispatch No. 363666 issued by the Japan Patent Office dated Aug. 2, 2022 for Japanese Patent Application No. 2018-224682.

*Primary Examiner* — Robert B Beatty
(74) *Attorney, Agent, or Firm* — Harness, Dickey & Pierce P.L.C.

(57) ABSTRACT

An image forming apparatus includes an image forming device configured to form an image on a sheet, and a cabinet configured to house the image forming device. The image forming device includes a side plate in which an exhaust port is formed, and the cabinet includes an outer side plate facing the side plate of the image forming device, and a positioning part configured to position the image forming device in the cabinet, the positioning part configured to form a space between the side plate of the image forming device and the outer side plate of the cabinet.

10 Claims, 7 Drawing Sheets

(51) Int. Cl.

| | |
|---|---|
| ***G03G 21/20*** | (2006.01) |
| ***B41J 29/377*** | (2006.01) |
| ***G03G 21/16*** | (2006.01) |
| ***A47B 81/00*** | (2006.01) |

(52) U.S. Cl.
CPC . *G03G 21/1619* (2013.01); *G03G 2221/1645* (2013.01); *G03G 2221/1678* (2013.01)

(58) Field of Classification Search
CPC .... A47B 81/00; A47B 2097/006; G11B 33/02
USPC ..... 399/92
See application file for complete search history.

(56) References Cited

U.S. PATENT DOCUMENTS

| | | | | |
|---|---|---|---|---|
| 9,320,765 | B2 * | 4/2016 | Bruheim | A61K 9/4825 |
| 9,566,811 | B2 * | 2/2017 | Vellutato, Jr. | B41J 29/377 |
| 2008/0050145 | A1 * | 2/2008 | Hanano | G03G 21/1633 399/92 |
| 2009/0245849 | A1 * | 10/2009 | Nakashima | G03G 21/206 399/92 |
| 2010/0007709 | A1 * | 1/2010 | Utsugi | B41J 29/377 347/108 |
| 2012/0240534 | A1 * | 9/2012 | Ryuzaki | G03G 21/206 55/385.4 |
| 2013/0108308 | A1 * | 5/2013 | Kondo | G03G 15/2017 399/92 |
| 2015/0223616 | A1 * | 8/2015 | Squitieri | A47B 96/16 312/326 |
| 2015/0241838 | A1 | 8/2015 | Ishida et al. | |
| 2015/0248880 | A1 | 9/2015 | Matsuda et al. | |
| 2015/0293494 | A1 | 10/2015 | Tanaka | |
| 2016/0033928 | A1 | 2/2016 | Ishimitsu et al. | |
| 2016/0274537 | A1 * | 9/2016 | Yamashita | G03G 21/206 |
| 2016/0291541 | A1 * | 10/2016 | Yamashita | G03G 21/206 |
| 2017/0219990 | A1 | 8/2017 | Ishida et al. | |
| 2017/0330546 | A1 | 11/2017 | Ishida et al. | |
| 2018/0101123 | A1 | 4/2018 | Ishida et al. | |
| 2018/0189007 | A1 * | 7/2018 | Akashi | G06F 3/1238 |
| 2019/0196396 | A1 | 6/2019 | Ueda et al. | |

FOREIGN PATENT DOCUMENTS

| | | | |
|---|---|---|---|
| JP | S 61-080267 | A | 4/1986 |
| JP | S 61-080268 | A | 4/1986 |
| JP | 2000-235396 | | 8/2000 |
| JP | 2001-236000 | A | 8/2001 |
| JP | 2005-067066 | | 3/2005 |
| JP | 2010-096952 | A | 4/2010 |
| JP | 2015-018052 | A | 1/2015 |
| JP | 2015-203777 | | 11/2015 |
| JP | 2018-005198 | | 1/2018 |
| JP | 2019-117887 | | 7/2019 |

* cited by examiner

IMAGE FORMING APPARATUS INCLUDING A CABINET WITH A POSITIONING PART CONFIGURED TO FORM A SPACE BETWEEN A SIDE PLATE HAVING AN EXHAUST PORT AND THE CABINET

CROSS-REFERENCE TO RELATED APPLICATION

This patent application is based on and claims priority pursuant to 35 U.S.C. § 119(a) to Japanese Patent Application No. 2018-224682, filed on Nov. 30, 2018 in the Japan Patent Office, the entire disclosures of which is hereby incorporated by reference herein.

BACKGROUND

Technical Field

An aspect of the present disclosure relates to an image forming apparatus.

Related Art

An image forming apparatus includes an exhaust port.

Specifically, the image forming apparatus includes a vertical exhaust duct serving as the exhaust port outside the image forming apparatus in a lateral direction of an apparatus body of the image forming apparatus. A printer is one example of the image forming apparatus.

SUMMARY

In an aspect of this disclosure, an image forming apparatus includes an image forming device configured to form an image on a sheet, and a cabinet configured to house the image forming device. The image forming device includes a side plate in which an exhaust port is formed, and the cabinet includes an outer side plate facing the side plate of the image forming device, and a positioning part configured to position the image forming device in the cabinet, the positioning part configured to form a space between the side plate of the image forming device and the outer side plate of the cabinet.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
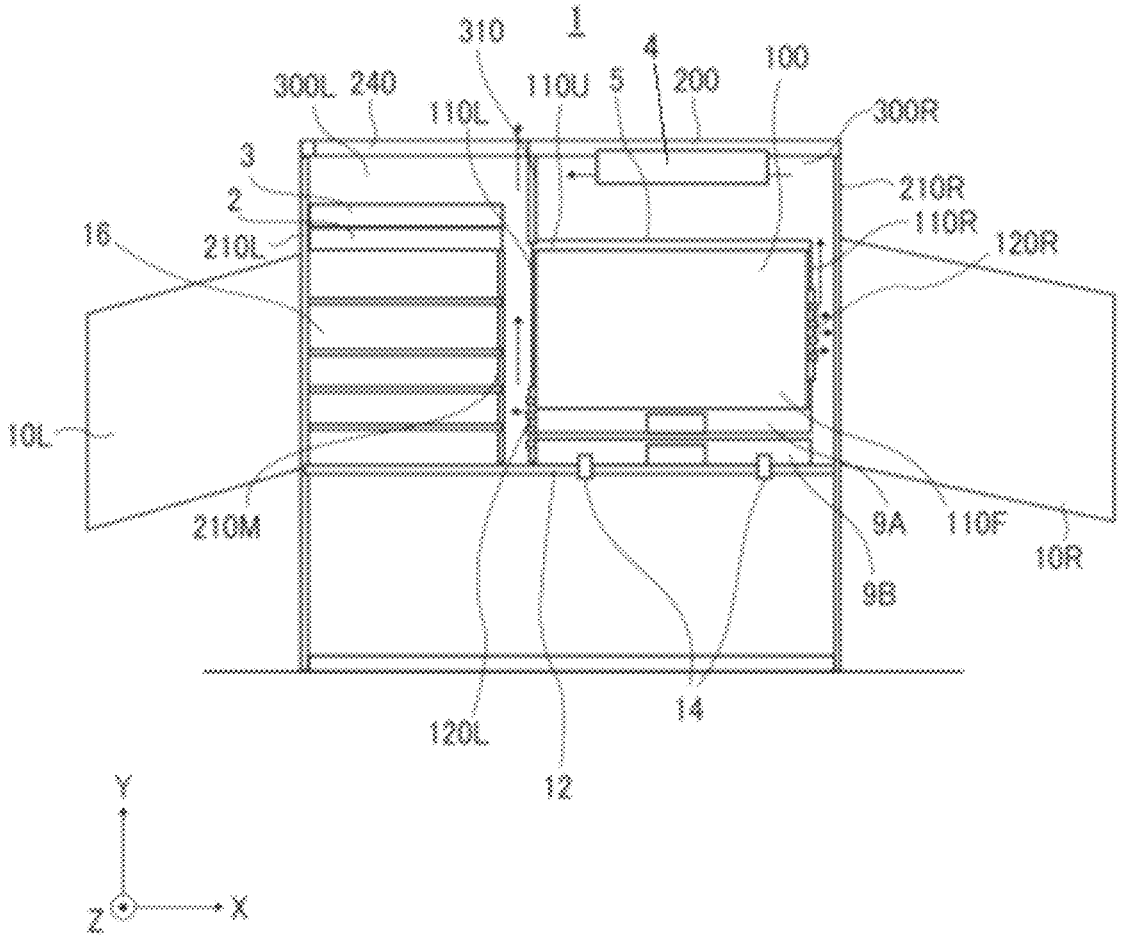
FIG. 1 is a front view of a cabinet according to a first embodiment of the present disclosure in which an interior of a cabinet is opened.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Embodiments of the present disclosure are described below with reference to the attached drawings. Referring now to the drawings, wherein like reference numerals designate identical or corresponding parts throughout the several views thereof, an image forming apparatus according to an embodiment of the present disclosure is described below.

Figure 2:
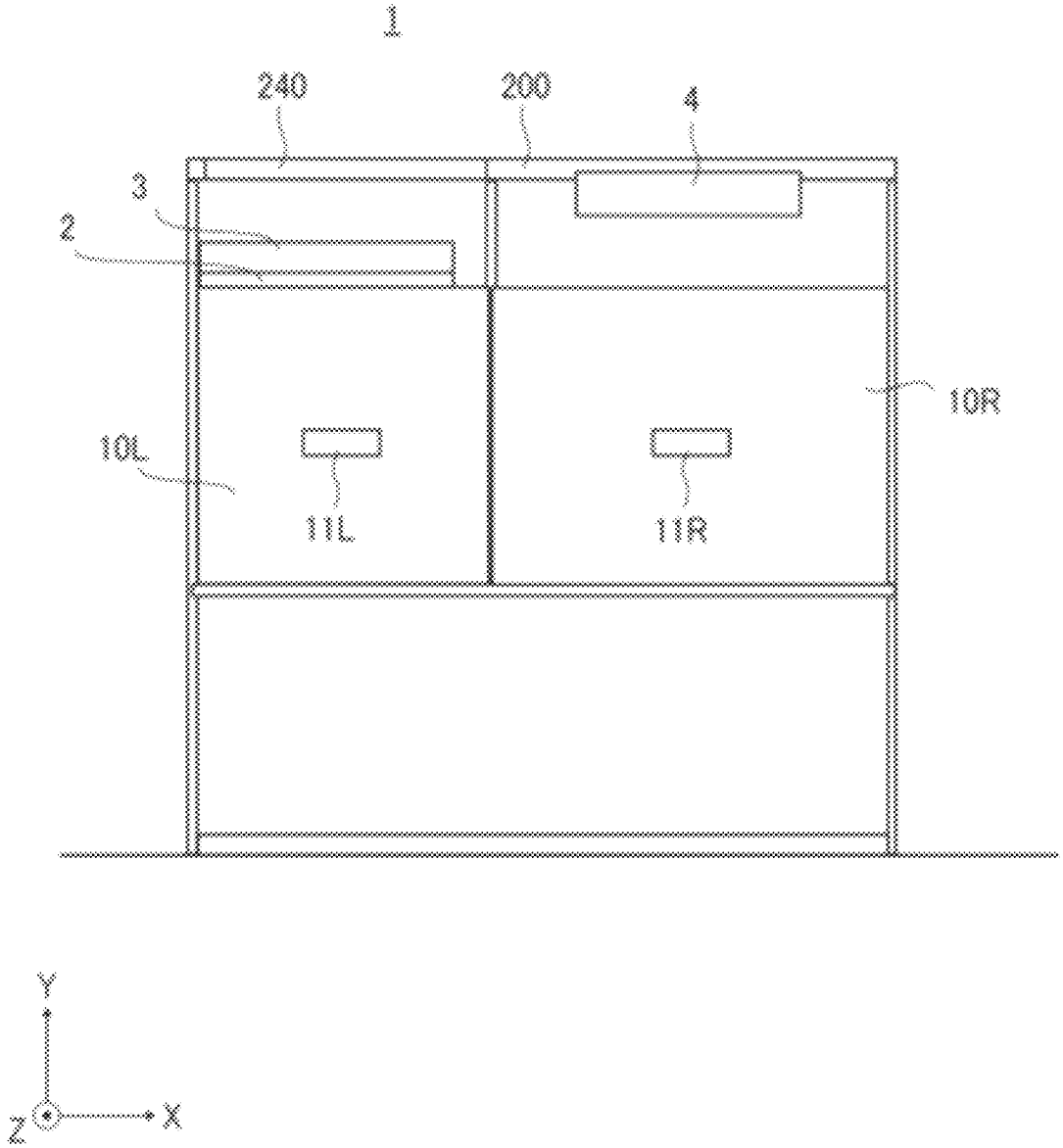
FIG. 2 is a front view of the cabinet in which the doors of the cabinet are closed in FIG. 1.

FIG. 1 is a front view of a cabinet 1 in which doors of the cabinet 1 are opened to open an interior of the cabinet 1 according to a first embodiment of the present disclosure. FIG. 2 is a front view of the cabinet 1 in which the doors of the cabinet 1 illustrated in FIG. 1 are closed.

The cabinet 1 is an example of a cabinet-integrated-type image forming apparatus that houses an image forming device 100 that forms an image on a sheet. Thus, the cabinet 1 is one example of the image forming apparatus. An X-axis direction indicated by arrow "X" in FIG. 1 is a width direction of the cabinet 1 and the image forming device 100. A Y-axis direction is a height direction of the cabinet 1 and the image forming device 100. A Z-axis direction is a depth direction of the cabinet 1 and the image forming device 100. A size of the cabinet 1 is 900 mm in the X-axis direction and 450 mm in the Z-axis direction. A general cabinet to store things can be arranged in parallel with the cabinet 1 in which the image forming device 100 is hosed.

The cabinet 1 includes a top plate 200, and a right door 10R, a handle 11R, the image forming device 100, a control panel 4, and a right upper space 300R on a right-side in the X-axis direction of the cabinet 1. The right door 10R is an example of an inner opening-and-closing cover to open an inner space of the cabinet 1 on the right-side in the X-axis direciton. The handle 11R is provided on the right door 10R. The control panel 4 is disposed at substantially the same height with a height of the top plate 200 and receives an operational input to the image forming device 100. The right upper space is a space formed between the top plate 200 and the image forming device 100.

Thus, the control panel 4 receives an operational input to the image forming device 100. The control panel 4 is disposed in a vicinity of the top plate 200 not overlapping with the opening 240.

A top surface of the top plate 200 is made flat so that a thing can be placed on the top plate 200, and the top plate 200 may be used as a work table.

The cabinet 1 further includes a left door 10L, a handle 11L, a shelf 16, a scanner 2, a document feeder 3, and a left upper space 300L on a left-side in the X-axis direciton of the cabinet 1. The left door 10L is an example of an inner opening-and-closing cover that opens the inner space of the cabinet 1. The handle 11L is provided on the left door 10L. The scanner 2 is disposed above the shelf 16 and reads an image on a document and sends image information to the image forming device 100. The document feeder 3 is disposed above the scanner 2. The document feeder 3 conveys the document, reads the image on the document, and sends the image information to the image forming device 100. The left upper space 300L is a space formed between the top plate 200 and the document feeder 3. Supplies such as toner and sheets may be placed in the left upper space 300L. The top plate 200 has an opening 240 formed above the left upper space 300L.

The cabinet 1 further includes a right side-plate 210R and a left side-plate 210L, a support plate 12, a positioning part 14, and a partition plate 310. The right side-plate 210R is arranged a right end, and the left side-plate 210L is arranged at a left end in the X-axis direction of the cabinet 1. The support plate 12 is an example of a support that supports the image forming device 100 and the shelf 16. The positioning part 14 positions the image forming device 100 to the support plate 12 with a screw or the like. The partition plate 310 partitions the right upper space 300R and the left upper space 300L. The partition plate 310 includes opening in a front side and rear side in the Z-axis direction of the cabinet 1. The right upper space 300R and the left upper space 300L communicate with each other through the opening in the partition plate 310.

The image forming device 100 includes a front side-plate 110F, a right side-plate 110R, a left side-plate 110L, a right exhaust port 120R, a left exhaust port 120L, an upper plate 110U, an ejection unit 5, and sheet feeders 9A and 9B. The front side-plate 110F is disposed at a front end in the Z-axis direction of the image forming device 100 and is an example of an inner opening-and-closing cover to open an interior of the image forming device 100. The right side-plate 110R is disposed at right end and a left side-plate 110L is disposed at a left end in the X-axis direction of the image forming device 100. The right exhaust port 120R is disposed on the right side-plate 110R, and the left exhaust port 120L is disposed on the right side-plate 110R. The upper plate 110U is disposed on an upper end in the Y-axis direction of the image forming device 100. The ejection unit 5 is disposed above the upper plate 110U and ejects the sheet on which an image is formed. Each of the sheet feeders 9A and 9B feeds sheets for image formation.

The ejection unit 5 is covered with the top plate 200 through the right upper space 300R. The right upper space 300R between the ejection unit 5 and the top plate 200 has a sufficient space to easily take out ejected sheets stacked on the ejection unit 5. The sheet feeders 9A and 9B serve as sheet trays on which sheets are stacked. The sheet feeders 9A and 9B are pulled toward a front direction of the image forming device 100, and at least a part of the sheet feeders 9A and 9B is of the image forming device 100 is drawn from an interior of the image forming device 100.

The shelf 16 includes a middle side-plate 210M disposed at a right end in the X-axis direction of the shelf 16. The left end of the shelf 16 in the X-axis direction is attached to (contact with) the left side-plate 210L of the cabinet 1. The shelf 16 may accommodate supplies such as toner and sheets.

The image forming device 100 as described-above includes the right exhaust port 120R on the right side-plate 110R, and the left exhaust port 120L on the left side-plate 110L. When the image forming device 100 integrated with the cabinet 1 is directly installed in an office, other equipment and devices installed at a side of the image forming device may directly receive exhaust discharged from the image forming device 100. Thus, the user of other equipment and devices may feel uncomfortable by the exhaust discharged from the image forming device 100.

To prevent the above-described problems, an image forming device may include a jam processing space outside a printer (image forming device 100) and a vertical exhaust duct in the jam processing space.

However, the image forming device including the jam processing space and the vertical exhaust duct is a so-called custom-made product. Thus, a configuration of the image forming device including the jam processing space and the vertical exhaust duct may not be applied to the image forming device 100 including an exhaust port on the side plates (left side-plate 110L and right side-plate 110R) of the image forming device 100. Thus, the above-described configuration of the image forming device including the jam processing space and the vertical exhaust duct may not solve a problem of utilizing the image forming device 100 that discharges exhaust from the side plates of the image forming device 100 during a desk work.

Further, a volume of the jam processing space of the image forming device that includes the vertical exhaust duct in the jam processing space has to be larger than a volume of a space necessary for jam processing. Thus, the image forming device including the jam processing space and the vertical exhaust duct may not effectively use the space in the image forming device. Further, the vertical exhaust duct is arranged vertically from a lower side to an upper side of the printer (image forming device). Thus, the vertical exhaust duct increase a number of parts of the image forming device compared to a configuration in which a duct is arranged in a horizontal direction (lateral direction) of the image forming device.

The cabinet 1 according to the present disclosure is made to solve the above-described problems. Thus, other equipment and devices installed on the side of the image forming device 100 do not directly receive the exhaust even when the image forming device 100 including an exhaust port on the side surface is installed next to the other equipment and devices. Thus, the user of other equipment and devices does not feel uncomfortable with the exhaust during the desk work in the cabinet 1 according to the present disclosure.

The right side-plate 210R (outer side plate) of the cabinet 1 faces the right side-plate 110R and the right exhaust port 120R of the image forming device 100. Further, the positioning part 14 positions the image forming device 100 in the cabinet 1 to the support plate 12 so that a space is formed between the right side-plate 110R of the image forming device 100 and the right side-plate 210R of the cabinet 1.

The positioning part 14 prevents the exhaust discharged from the right exhaust port 120R to be directly discharged outside the cabinet 1. Thus, other equipment and devices installed on the side of the cabinet 1 do not directly receive the exhaust discharged from the image forming device 100. Thus, it becomes easier to install other equipment and devices on the side of the image forming device 100 and the cabinet 1.

Further, the cabinet 1 covers (houses) the image forming device 100 so that the cabinet 1 can reduce joints of an exterior of an image forming apparatus and improve design aesthetics of image forming device 100. The cabinet 1 can reduce noise so that the user during the desk work may not feel uncomfortable even if the image forming device 100 and the cabinet 1 are placed near the user during the desk work. Thus, the cabinet 1 according to the present disclosure enables comfortable desk work while fully using the image forming device 100 including the exhaust port on the side surface.

A middle side-plate 210M of the shelf 16 faces the left side-plate 110L and the left exhaust port 120L of the image forming device 100. The positioning part 14 positions the image forming device 100 to the support plate 12 to form a space between the left side-plate 110L and the middle side-plate 210M.

The right side-plate 210R of the cabinet 1 does not include an exhaust port. The opening 240 formed on a left side of the top plate 200 communicates with the space between the right side-plate 110R of the image forming device 100 and the right side-plate 210R of the cabinet 1.

Specifically, in a state in which the right door 10R and the left door 10L are closed, the exhaust discharged from the right exhaust port 120R passes through a space between the right side-plate 110R and the right side-plate 210R, a space between an upper plate 100U and the top plate 200, an opening in a partition plate 310, and is discharged outside the cabinet 1 from the opening 240 of the top plate 200 by natural convection. The exhaust discharged from the left exhaust port 120L passes through the space between the left side-plate 110L and the middle side-plate 210M, reaches to the opening 240, and is discharged outside the cabinet 1 by the natural convection. The upper plate 100U configures a top surface of the image forming device 100.

Thus, the heat in the image forming device 100 is discharged from the opening 240. Therefore, the cabinet 1 can reduce an increase in a temperature in the space between the image forming device 100 and the cabinet 1 while making it easier to install other equipment and devices on the sides of the image forming device 100 and the cabinet 1.

The control panel 4 is disposed on a right side of the top plate 200 and is arranged not to overlap the opening 240 disposed left side of the top plate 200. Thus, the exhaust is not directly discharged to the user operating the control panel 4.

Even when the right door 10R and the left door 10L are opened, the image forming device 100 can form an image on a sheet and discharge the sheet on which the image is formed to the ejection unit 5. Thus, the cabinet 1 can prevent the image forming device 100 from stopping image forming process every time the right door 10R or the left door 10L is opened. Thus, the cabinet 1 can prevent deterioration of workability such as supplying the sheet to the image forming device 100.

Thus, the image forming device 100 is operable in a state in which the opening-and-closing cover (at least one of the right door 10R and the left door 10L) is opened.

Even when the image forming device 100 is in printing (image forming process), the user can open the right door 10R and the left door 10L to replenish or remove stored items such as toner and supplies stored in the shelf 16.

Conversely, the image forming device 100 does not (stops to) form an image on the sheet when the front side-plate 110F is opened. Thus, the image forming device can ensure safety. The front side-plate 110F is an example of the inner opening and closing cover to open and close an inner space of the image forming device 100.

Thus, the image forming device 100 includes an inner opening-and-closing cover (front side-plate 110F) to open and close an inner space of the image forming device 100, and the image forming device 100 stops forming an image on a sheet when the inner opening-and-closing cover (front side-plate 110F) is opened.

Figure 3A:
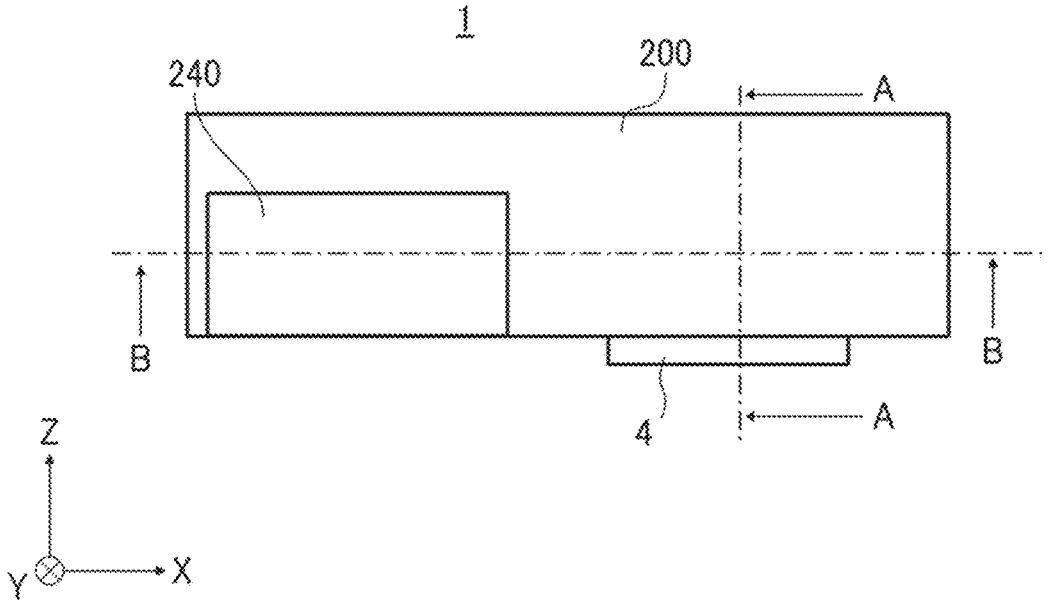
FIG. 3A is a top view of the cabinet illustrated in FIG. 1.
Figure 3B:
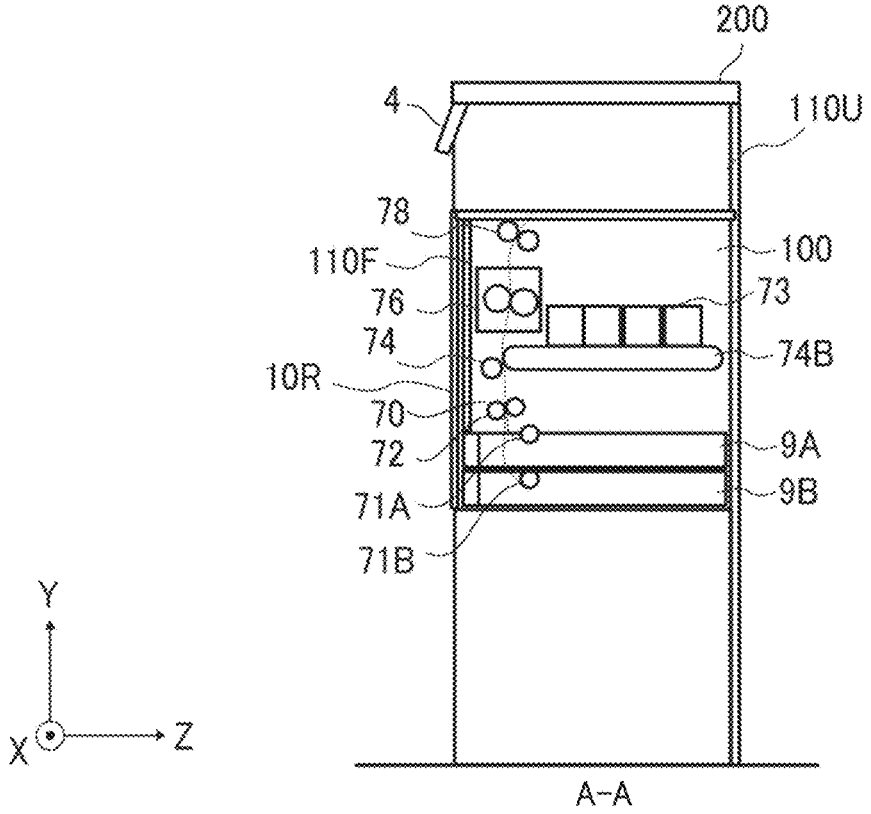
FIG. 3B is a cross-sectional view of the cabinet along a line A-A in FIG. 3A.

FIG. 3A is a top view of the cabinet 1 illustrated in FIG. 1, and FIG. 3B is a cross-sectional view of the cabinet along a line A-A in FIG. 3A.

The image forming device 100 includes feeding rollers 71A and 71B, a conveyance path 70, a registration roller 72, image forming unit 73, an intermediate transfer belt 74B, a transfer unit 74, a fixing unit 76, and an ejection roller 78. The feeding rollers 71A and 71B feed sheets from the sheet feeders 9A and 9B. The conveyance path 70 conveys the sheets. The registration roller 72 adjusts timing of conveyance of the sheet fed from the feeding rollers 71A and 71B.

The image forming unit 73 forms an image of each color of black, cyan, magenta, and yellow on the sheet. The intermediate transfer belt 74B intermediately transfers an image of each color formed by the image forming unit 73. The transfer unit 74 secondary-transfers the image intermediately transferred to the sheet conveyed through the conveyance path 70. The fixing unit 76 fixes the secondary-transferred image on the sheet. The ejection roller 78 ejects the sheet, on which the image is formed, in a depth direction in the Z-axis direction to the ejection unit 5.

In the above-described embodiment, the image forming device 100 of a so-called full-color electrophotographic system illustrated in FIG. 3 has been described as an example of the image forming device 100. Note that the system of the image forming device is not limited to such a full-color electrophotographic system. For example, the image forming device 100 may be a monochrome electrophotographic type to form a monochrome image on the sheet using only black toner. Alternatively, the image forming device 100 may be an inkjet type image forming apparatus in which an inkjet head forms an image on a sheet conveyed from each of the sheet feeders 9A and 9B.

Figure 4:
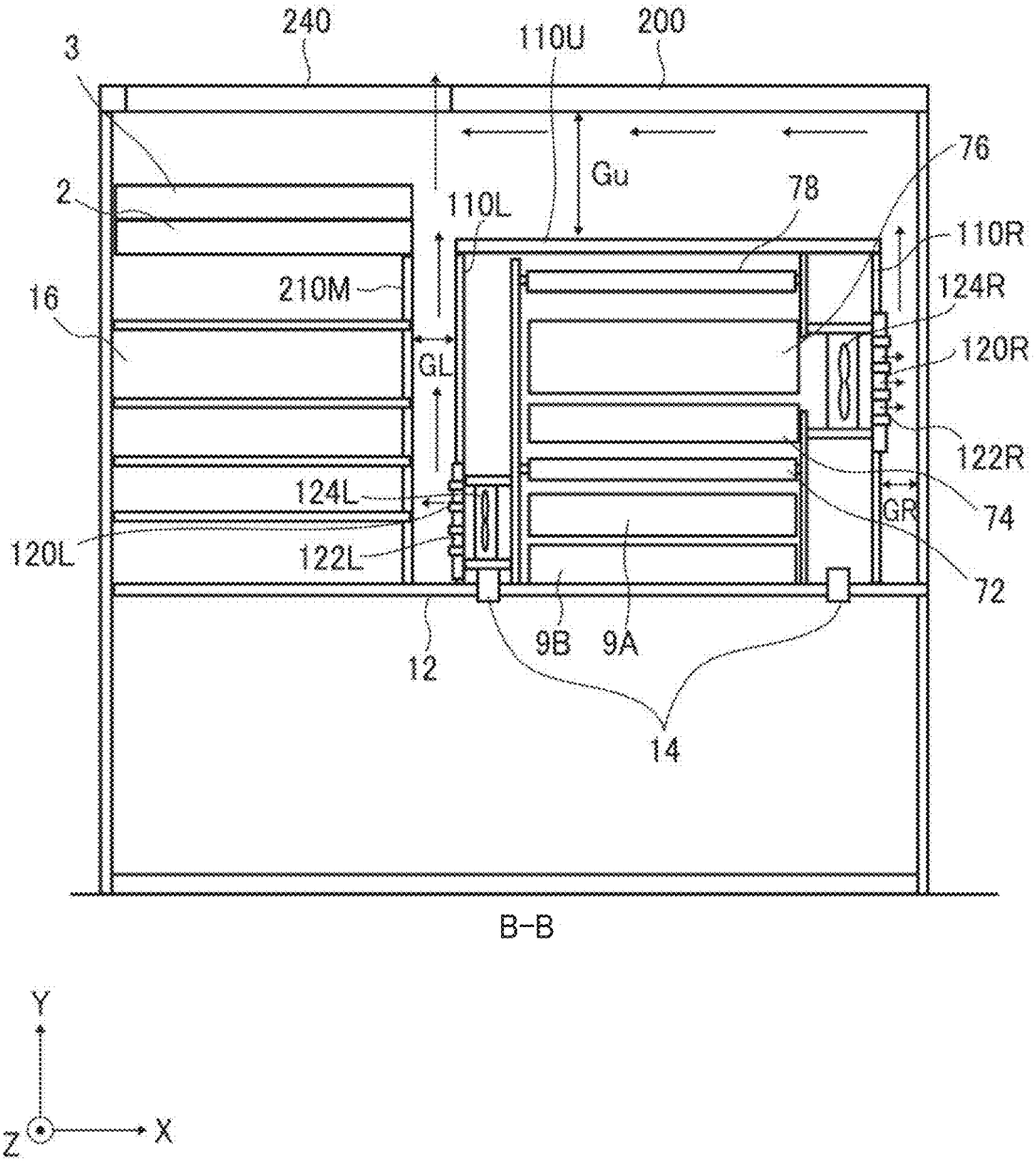
FIG. 4 is an enlarged cross-sectional view of the cabinet illustrated in FIG. 1 along a line B-B in FIG. 3A.

FIG. 4 is an enlarged cross-sectional view of the cabinet 1 illustrated in FIG. 1 along a line B-B in FIG. 3A. A cross-section of the cabinet 1 along the line B-B corresponds to the opening 240 in the partition plate 310. The partition plate 310 is illustrated in FIG. 1.

A right fan 124R is disposed inside the right side-plate 110R of the image forming device 100. A right louver 122R is provided at the right exhaust port 120R of the right side-plate 110R. Further, a left fan 124L is disposed inside the left side-plate 110L of the image forming device 100. A left louver 122L is provided at the left exhaust port 120L of the left side-plate 110L.

The right fan 124R and the left fan 124L discharges heat generated by the fixing unit 76 and the like from the right exhaust port 120R and the left exhaust port 120L.

The exhaust discharged from the right exhaust port 120R passes through the space between the right side-plate 110R and the right side-plate 210R, passes through the space between the upper plate 100U of the image forming device 100 and the top plate 200 of the cabinet 1, reaches to the opening 240 of the partition plate 310, and is discharged outside the cabinet 1 by the natural convection.

Specifically, an internal temperature in the image forming device 100 increases due to heat generated by the fixing unit 76 and the like when the image forming device 100 is operated. Since the exhaust discharged from the right exhaust port 120R is higher than the temperature inside the cabinet 1 (and outside the image forming device 100) as well as the outside of the cabinet 1, the exhaust travels upward through the space between the right side-plate 110R and the right side-plate 210R by natural convection.

The exhaust discharged from the left exhaust port 120L passes through the space between the left side-plate 110L and the middle side-plate 210M, reaches to the opening 240, and is discharged outside the cabinet 1 by the natural convection in the same manner as the exhaust discharged from the right exhaust port 120R outside the cabinet 1.

Here, a gap Gu between the upper plate 100U (upper surface) of the image forming device 100 and the top plate 200 of the cabinet 1 is larger than each of a gap GR between the right side-plate 110R and the right side-plate 210R and a gap GL between the left side-plate 110L and the middle side-plate 210M.

Thus, even if the sheets ejected on the upper plate 100U of the image forming device 100 are stacked, a large space can be secured between the upper plate 100U and the top plate 200. Thus, the heat in the image forming device 100 can be effectively discharged from the opening 240.

Figure 5:
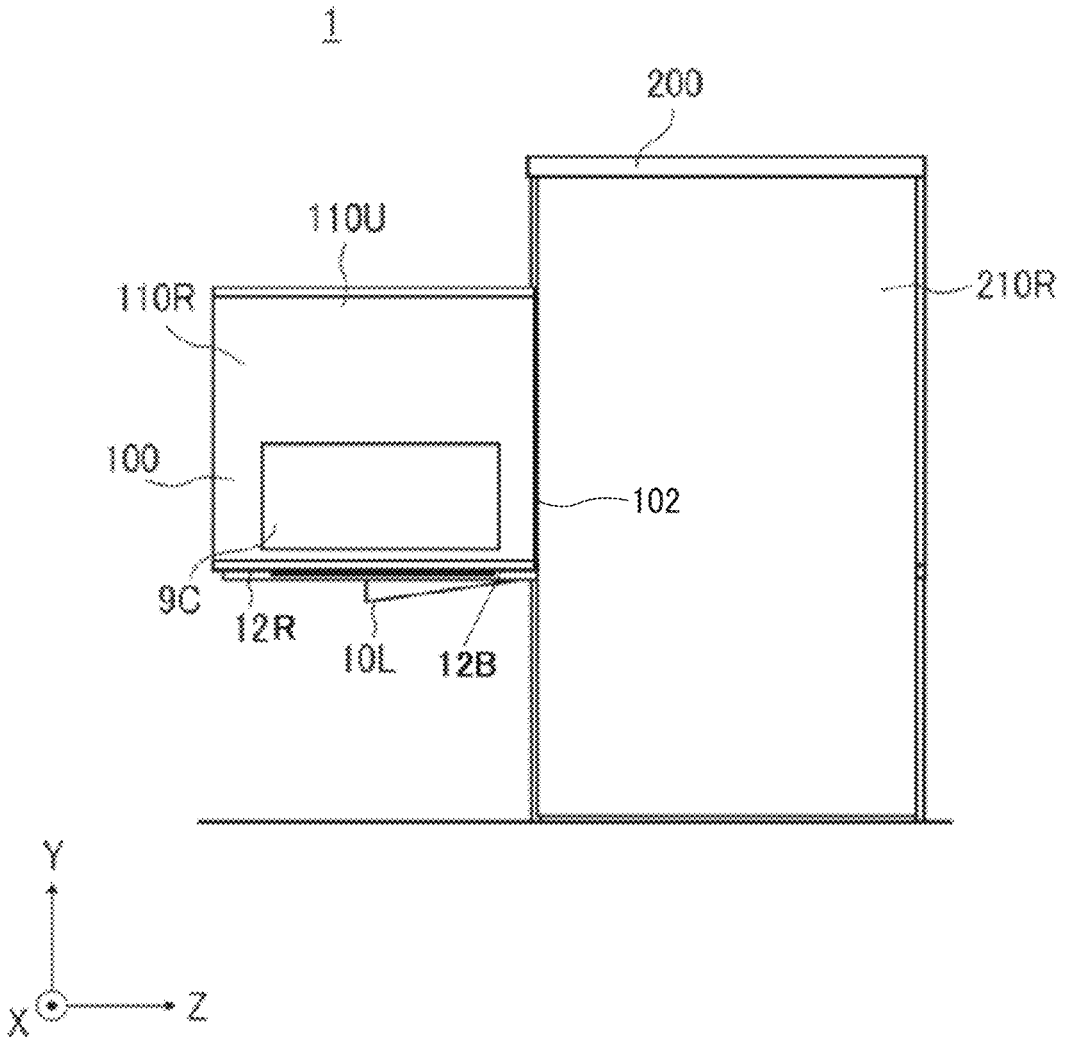
FIG. 5 is a side view of the cabinet in use in FIG. 1.

FIG. 5 is a side view of the cabinet 1 in use in FIG. 1. The image forming device 100 includes, on the right side-plate 110R, a manual sheet tray 9C that feeds a sheet for image formation. FIG. 5 illustrates a usage condition in which the image forming device 100 is drawn from the cabinet 1 in order to use the manual sheet tray 9C. In order to pull out the image forming device 100, the right door 10R and the left door 10L are opened. The right door 10R is illustrated in FIGS. 1 and 2.

The support plate 12 includes a pair of guide rails 12R provided on the support plate 12 and a support plate 12B provided on the pair of guide rails 12R. The support plate 12B supports the image forming device 100, and the support plate 12B and the pair of guide rails 12R can be drawn from the cabinet 1 so that the image forming device 100 on the support plate 12B can be pulled out of (drawable from) the cabinet 1. The positioning part 14 positions the image forming device 100 on the support plate 12B so that the image forming device 100 is positioned on the support plate 12 in the X-axis direction. The image forming device 100 and the scanner 2 and the like are electrically connected to the cabinet 1 by wiring 102. Thus, the electrical connection is maintained even if the image forming device 100 is drawn from the cabinet 1 as illustrated in FIG. 5. Thus, the image forming device 100 can form an image on a sheet using the manual sheet tray 9C. The support plate 12B has an enough length to support the image forming device 100 in the X-axis direction.

Thus, the image forming device 100 is electrically connected to the cabinet 1 in a state in which the support (support plate 12B) is drawn from the inner space of the cabinet 1 outside the cabinet 1.

The support plate 12B can move forward in the Z-axis direction (leftward in FIG. 5), and can be drawn from the internal space to an external space of the cabinet 1. Therefore, the image forming device 100 positioned by the support plate 12B can also be drawn from the internal space to the external space of the cabinet 1. Thus, the manual sheet tray 9C can be drawn from the cabinet 1, and a workability of paper feeding from the manual sheet tray 9C is improved.

The image forming device 100 can form an image on a sheet and eject the sheet on which the image is formed even when the support plate 12B is drawn from the cabinet 1. Thus, the image forming device 100 does not stop image formation when the support plate 12B is drawn from the cabinet 1. Thus, the cabinet 1 can prevent decrease in a workability of paper feeding from the manual sheet tray 9C and the like.

Figure 6:
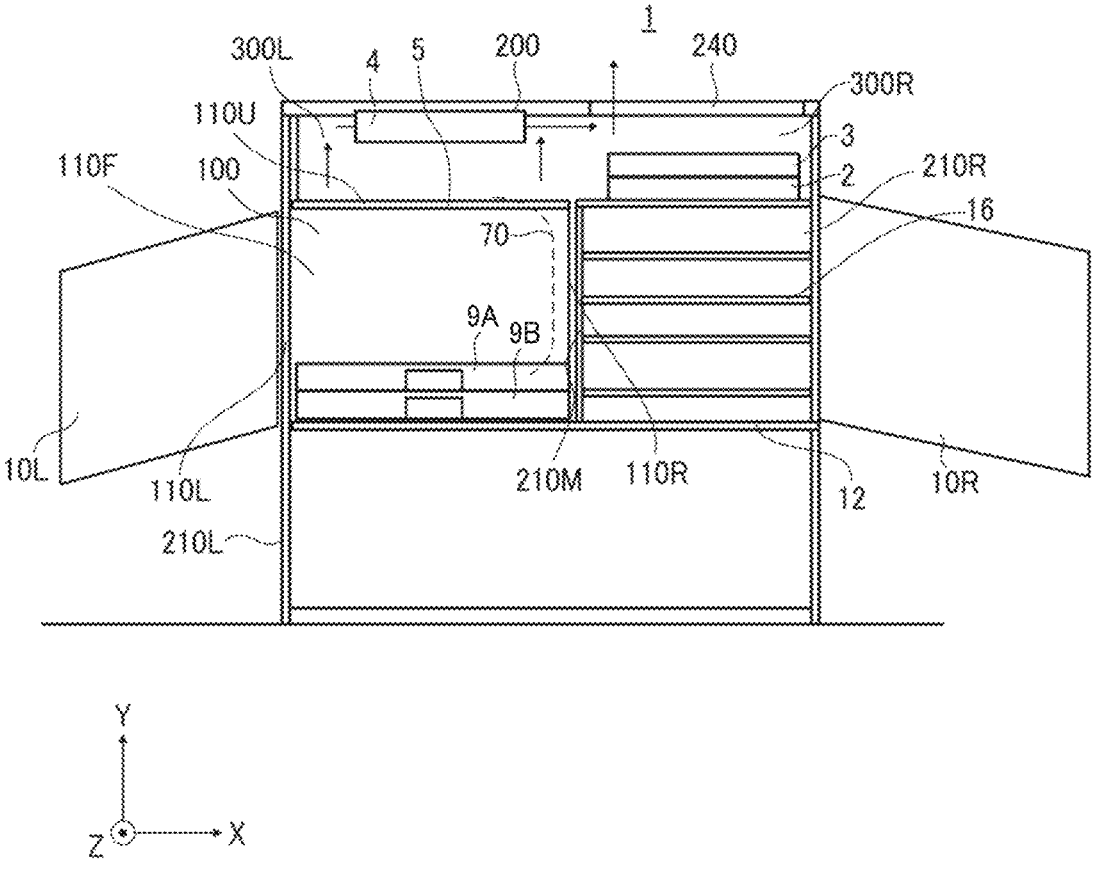
FIG. 6 is a front view of the cabinet illustrating a variation of the cabinet in FIG. 1.

FIG. 6 is a front view of the cabinet 1 illustrating a variation of the cabinet 1 in FIG. 1.

The cabinet 1 in FIG. 6 is different from the cabinet in FIG. 1 such that the cabinet 1 in FIG. 6 includes a left upper space 300L that is a space formed by the image forming device 100, the control panel 4, the top plate 200, and the left side-plate 210L on a left side in the X-axis direction of the cabinet 1.

Unlike the cabinet 1 illustrated in FIG. 1, the cabinet 1 in FIG. 6 includes a shelf 16, a scanner 2 disposed above the shelf 16, a document feeder 3 disposed above the scanner 2, a right upper space 300R that is a space formed between the top plate 200 and the document feeder 3 on a right side of the cabinet 1 in the X-axis direction. The opening 240 is formed in the top plate 200 above the right upper space 300R.

A conveyance path 70 of the image forming device 100 is indicated by a dotted line in FIG. 6. Unlike the cabinet 1 in FIG. 1, the cabinet 1 in FIG. 6 ejects the sheet, onto which the image is formed, leftward in the X-axis direction.

Figure 7A:
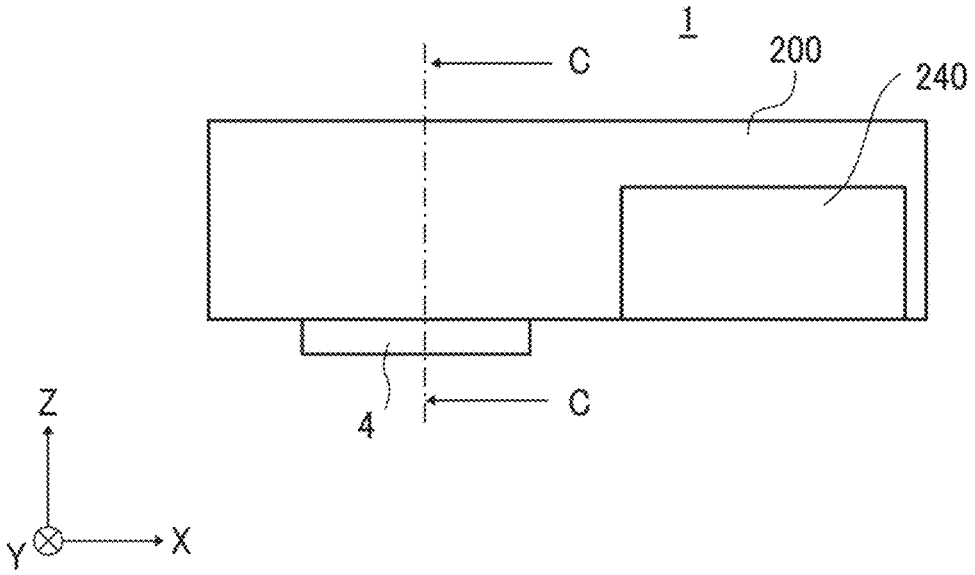
FIG. 7A is a top view of the cabinet illustrated in FIG. 6.
Figure 7B:
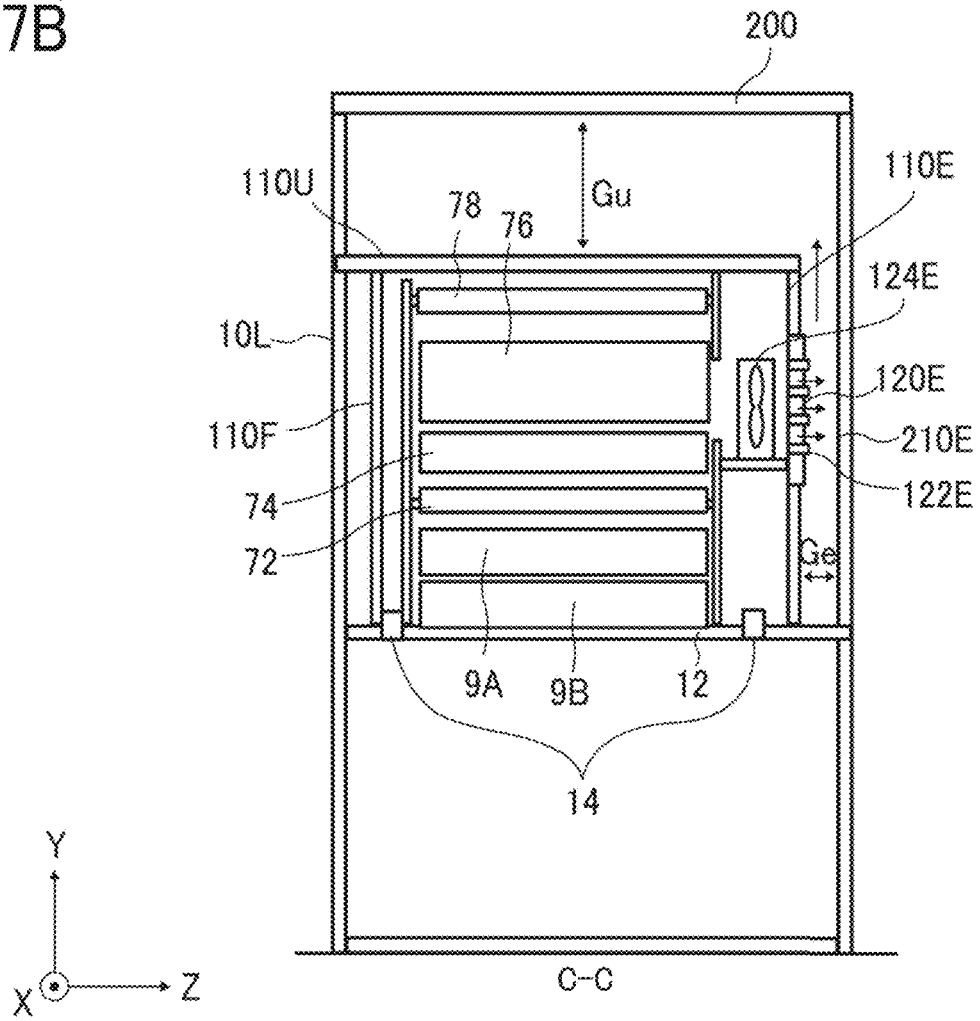
FIG. 7B is a cross-sectional view of the cabinet along a line C-C in FIG. 7A.

FIG. 7A is a top view of the cabinet 1 in FIG. 6. FIG. 7B is a cross-sectional side view of the cabinet 1 along a line C-C in FIG. 7A.

The cabinet 1 includes a rear side-plate 210E disposed at a rear end in the Z-axis direction. The image forming device 100 includes a rear side-plate 110E disposed at the rear end in the Z-axis direction and a rear exhaust port 120E disposed in the rear side-plate 110E.

The image forming device 100 includes a rear fan 124E inside the rear side-plate 110E and a rear louver 122E in the rear exhaust port 120E. The rear fan 124E discharges the heat generated by the fixing unit 76 and the like from the rear exhaust port 120E.

The rear side-plate 210E (outer side-plate) of the cabinet 1 faces the rear side-plate 110E and the rear exhaust port 120E of the image forming device 100. Further, the positioning part 14 positions the image forming device 100 to the support plate 12 so that a space is formed between the rear side-plate 110E of the image forming device 100 and the rear side-plate 210E of the cabinet 1.

The positioning part 14 prevents the exhaust discharged from the rear exhaust port 120E to be directly discharged outside the cabinet 1. Thus, other equipment and devices installed on the rear side of the cabinet 1 do not directly receive the exhaust discharged from the image forming device 100. Thus, it becomes easier to install other equipment and devices on the rear side of the image forming device 100 and the cabinet 1.

The exhaust discharged from the rear exhaust port 120E passes through the space between the rear side-plate 110E and the rear side-plate 210E, passes through the space between the upper plate 100U of the image forming device 100 and the top plate 200 of the cabinet 1, reaches to the opening 240, and is discharged outside the cabinet 1 by the natural convection.

Here, a gap Gu between the upper plate 100U of the image forming device 100 and the top plate 200 of the cabinet 1 is larger than a gap Ge between the rear side-plate 110E and the rear side-plate 210E.

Thus, even if the sheets ejected on the upper plate 100U of the image forming device 100 are stacked, a large space can be secured between the upper plate 100U and the top plate 200. Thus, the heat in the image forming device 100 can be effectively discharged from the opening 240.

The above-described embodiments describes the cabinet 1 that houses an image forming device 100 that forms an image on a sheet. However, the image forming device 100 that forms an image on a sheet may be referred to as an apparatus body, and the cabinet 1 may be referred to as an image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image forming device configured to form an image on a sheet, the image forming device including a side plate in which an exhaust port is formed; and a cabinet configured to house the image forming device, the cabinet including:

an outer side plate facing the side plate of the image forming device, a positioning part configured to position the image forming device in the cabinet, the positioning part configured to form a space between the side plate of the image forming device and the outer side plate of the cabinet, and a top plate above the image forming device, the top plate including an opening communicating with the space between the side plate of the image forming device and the outer side plate of the cabinet, wherein a gap between the top plate of the cabinet and an upper surface of the image forming device is larger than a gap between the side plate of the image forming device and the outer side plate of the cabinet.

2. The image forming apparatus according to claim 1, wherein an exhaust is discharged from the image forming device through the opening.

3. The image forming apparatus according to claim 1, further comprising:

a control panel configured to receive an operational input to the image forming device, wherein the control panel is disposed in a vicinity of the top plate not overlapping with the opening.

4. The image forming apparatus of claim 1, further comprising:

an opening-and-closing cover configured to open and close an inner space of the cabinet, wherein the cabinet includes:

a support plate connected to the outer side plate and configured to support the image forming device, and the positioning part provided as a pair of positioning parts attached to the support plate, the pair of positioning parts configured to abut the image forming apparatus to define limit positions for the image forming device on the support plate in a width direction of the cabinet, the pair of positioning parts configured to form the space between the side plate of the image forming device and the outer side plate of the cabinet.

5. The image forming apparatus according to claim 4, wherein the image forming device is operable in a state in which the opening-and-closing cover is opened.

6. The image forming apparatus according to claim 5, wherein the image forming device includes an inner opening-and-closing cover configured to open and close an inner space of the image forming device, and the image forming device stops operation in a state in which the inner opening-and-closing cover is opened.

7. The image forming apparatus according to claim 4, wherein an exhaust is discharged from the image forming device through the opening in the top plate of the cabinet.

8. The image forming apparatus according to claim 4, further comprising:

a control panel configured to receive an operational input to the image forming device.

9. The image forming apparatus of claim 1, wherein the cabinet includes:

a support plate onto which the image forming device is placed, the support plate configured to support the image forming device, the support plate being drawable from an inner space of the cabinet to outside the cabinet, and the positioning part provided as a pair of positioning parts attached to the support plate, the pair of positioning parts configured to abut the image forming apparatus to define limit positions for the image forming device on the support plate in a width direction of the cabinet, the pair of positioning parts configured to form the space between the side plate of the image forming device and the outer side plate of the cabinet.

10. The image forming apparatus according to claim 9, wherein the image forming device is electrically connected to the cabinet in a state in which the support plate is drawn from the inner space of the cabinet to outside the cabinet.

* * * * *